United States Patent [19]

Couchman

[11] 3,941,570

[45] Mar. 2, 1976

[54] CONICALLY CAPPED EXTRUSION BILLET

[75] Inventor: Richard Couchman, New Kensington, Pa.

[73] Assignee: Aluminum Company of America, Pittsburgh, Pa.

[22] Filed: July 18, 1974

[21] Appl. No.: 489,504

Related U.S. Application Data

[62] Division of Ser. No. 296,013, Oct. 10, 1972, Pat. No. 3,862,286.

[52] U.S. Cl. ..... 29/187.5; 29/191.2

[51] Int. Cl.[2] ..... B32B 15/00

[58] Field of Search ..... 29/182.2, 187.5, 191.2, 29/420, 420.5; 72/258; 75/208 R; 264/111; 428/208, 242, 328

[56] References Cited

UNITED STATES PATENTS

| | | | |
|---|---|---|---|
| 3,010,196 | 11/1961 | Smith et al. | 29/420.5 |
| 3,335,001 | 8/1967 | Drew et al. | 75/208 R |
| 3,373,003 | 3/1968 | Schreiner | 29/182.2 |
| 3,510,935 | 5/1970 | Durrwachter et al. | 29/182.2 X |
| 3,560,170 | 2/1971 | Durrwachter et al. | 29/182.2 |
| 3,620,059 | 11/1971 | Nilsson | 29/187.5 X |
| 3,780,418 | 12/1973 | Hurst | 29/191.2 X |

*Primary Examiner*—L. Dewayne Rutledge
*Assistant Examiner*—O. F. Crutchfield
*Attorney, Agent, or Firm*—Robert E. Isner

[57] ABSTRACT

Improved terminal end configuration for composite multi-metallic extrusion billets providing a reservoir of cladding metal for the initially extrudable portions thereof by selective introduction of metal powders into discrete core and cladding cavities within a deformable shell followed by isostatic compaction thereof.

3 Claims, 12 Drawing Figures

CONICALLY CAPPED EXTRUSION BILLET

Figure 1:
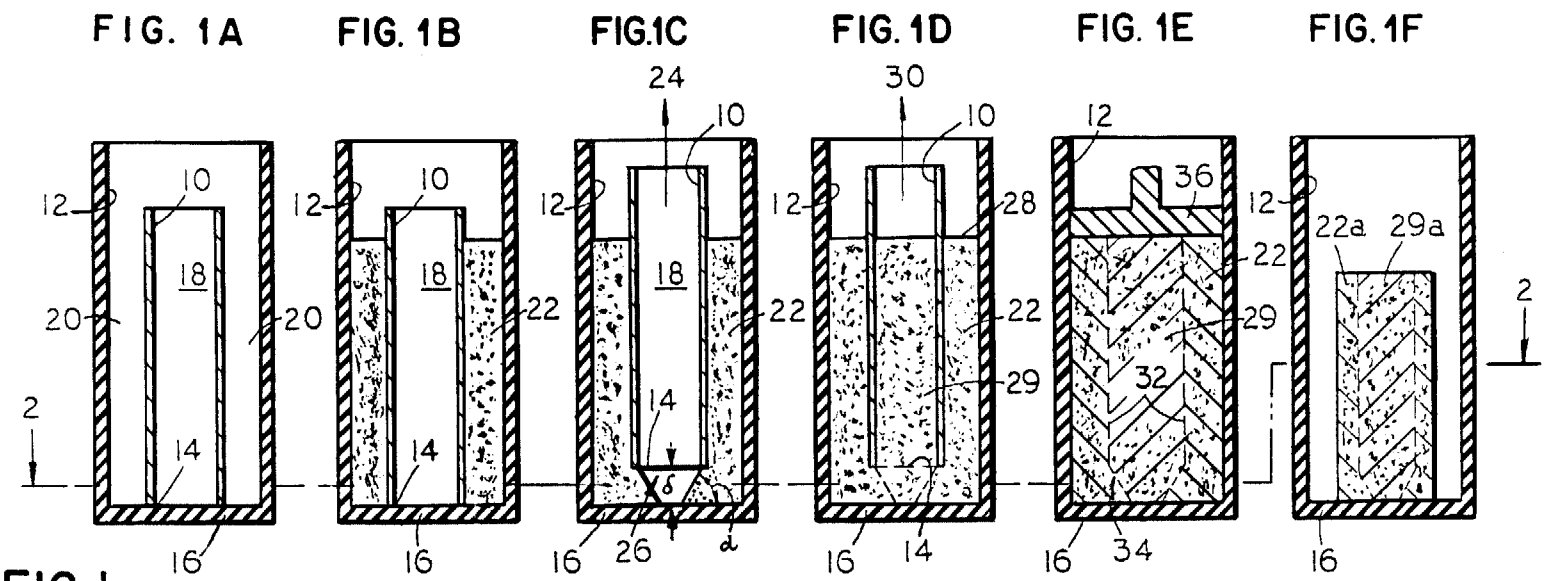

This application is a division of application Ser. No. 296,013 filed Oct. 10, 1972, now U.S. Pat. No. 3,862,286.

This invention relates to compacted powdered metal billets of improved internal terminal and configuration for extrusion operations and particularly to the fabrication of such improved composite extrusion billets from aluminum base alloy powders of differing metallurgical characteristics to provide an increased yield of selectively clad aluminum base alloy products.

The extrusion of certain types of non-planar composite multi-metallic products, such as rods, bars, tubes or shapes, from two or more metals or metal alloys of differing metallurgical characteristics by conventional practices is presently characterized by a limited product yield due to a lack of uniformity in, and failure of, the initially extruded portion of the final product to conform to the desired internal configuration of core and cladding metal. Such lack of uniformity in the initially extruded product results in both product wastage through rejection and in undue expense attendant therewith.

This invention may be briefly described as an improved terminal end configuration for composite multimetallic extrusion billets made up of at least 2 discrete metal constituents of differing metallurgical characteristics to provide a reservoir of cladding metal for the initially extruded portions thereof for extrusion type formation of selectively clad products. In its broader aspects, the subject invention includes the positioning of an elongate hollow partition member of a first predetermined cross-sectional configuration within a closed end deformable shell of a second predetermined cross-sectional configuration and of at least substantially commensurate length therewith, with the dependent end of such partition member being initially disposed in abutting relation with the closed end defining wall portion of the shell member to cooperatively define at least one discrete powdered metal receiving core cavity and a powdered metal receiving cladding cavity disposed in surrounding relation therewith. Finely divided particles of a cladding metal of a first metallurgical character are then selectively introduced into said cladding cavity, after which displacement of the hollow partition such as to position its said dependent end in predetermined spaced relation from said closed end defining wall portion of the deformable shell permits said previously introduced cladding metal powder to generally diagonally flow into the dependent end of said core cavity and to there assume a generally conical configuration determined by the angle of repose of said cladding metal powder and the spacing of the dependent end of the partition member from the closed end defining wall portion of the shell member. The cladding cavity is then substantially filled with finely divided particles of said cladding metal and the modified configuration core cavity, as now defined by the elevated partition member and by those portions of the cladding metal powder now disposed at the bottom thereof, is simultaneously or sequentially filled with finely divided particles of core metal of a metallurgical character different from that of said cladding metal. The partition member is then axially removed from the shell, serving to introduce the partition engaging surfaces of said core and cladding metal particles into intimate interfacially engaged relation at a defined interface therebetween and to provide a powder preform having a selectively contoured internal terminal end configuration. The deformable shell and its contents are then subjected to isostatic compaction, as by application of hydrostatic pressure, to compact said selectively disposed finely divided metals to a predetermined desired density without any appreciable change in the relative physical positional disposition of such metals, one to the other, to provide a composite billet having a generally conically shaped cap of cladding metal disposed at one terminal end thereof.

In its narrower aspects, the subject invention is directed to the fabrication of composite aluminum base alloy billets for extrusion purposes having one terminal end selectively contoured to provide an excess of selectively located cladding material to minimize wastage of the initially extruded final product therefrom.

Among the advantages of the subject invention is the permitted simple and inexpensive formation of improved composite selectively contoured multi-metallic billets to minimize wastage of the initially extruded portions of final product formed therefrom. Another advantage of the subject invention is the permitted fabrication, at markedly reduced cost and expense, of compacted composite billets of aluminum base alloy powders of predetermined desired configuration suitable for direct utilization with minimal product wastage in subsequent extrusion operations. A further advantage of the subject invention is the permitted fabrication of improved cold compacted composite multi-alloy billets for high yield extrusion of selectively clad aluminum base alloy products from at least two aluminum base alloy powders of differing metallurgical character that dispenses with the need for sintering and which permits production of increased yields of acceptably bonded clad product of desired internal and external configuration upon subsequent extrusion thereof.

The primary object of this invention is the provision of an improved structure for composite multimetallic billets of predetermined desired internal and external configurations for extrusion type fabrication operations.

Another object of the invention is the provision of an improved structure for composite multi-alloy billets formed of aluminum base alloy powders to provide increased yields of extruded selectively clad shaped aluminum base alloy products.

Other objects and advantages of this invention will be apparent from the following portions of this specification and from the appended drawings which schematically illustrate, in accordance with the mandate of the patent statutes, certain presently preferred operations deemed by the inventor to incorporate the principles of this invention.

Referring to the drawings

FIGS. 1*a* through 1*f* schematically illustrate, in vertical section, features of a preferred sequence of steps employable in the fabrication of improved multimetallic billets in accord with the principles of this invention.

FIGS. 2*a* through 2*f* are horizontal sections as taken on line 2—2 through FIGS. 1*a* through 1*f*, respectively.

By way of introduction, this invention is in the nature of a further improvement over the innovative advances described in the copending application of A. L. Hurst, Ser. No. 296,006 and filed on even date herewith now U.S. Pat. No. 3,780,418. Reference may be had thereto for an amplified disclosure on the basic techniques of forming multi-metal composites of predetermined general internal and external configuration from powdered metal constituents of differing metallurgical character.

Figure 2:
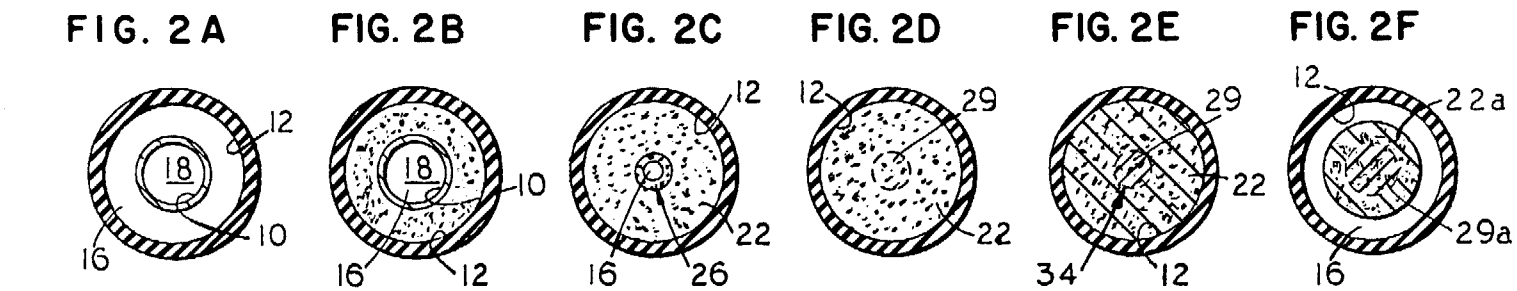

Referring now to the drawings, and particularly to FIGS. 1 and 2, there is schematically and exemplarily illustrated features of certain of the sequenced steps employable in accord with the principles of this invention in the fabrication of the improved type of composite multi-alloy billets for the extrusion of selectively clad aluminum base alloy products. To the above ends, and as shown in FIG. 1*a*, an open ended, elongate and thin-walled hollow partition member, conveniently in the form of a cylindrical core tube 10 of circular cross-section is co-axially disposed within a closed end deformable shell 12 of a second predetermined cross-sectional configuration. In the illustrated structure, the shell 12 is also of circular cross-section to ultimately form a cylindrical billet particularly adapted for extrusion purposes and is of a length generally commensurate with that of the core tube 10. Such co-axial disposition of the open ended core tube 10 within the closed end shell 12 with the dependent open end 14 thereof disposed in abutting relation with the closed end defining wall portion 16 of the deformable shell 12 results in the formation of a pair of discrete powder receiving cavities or receptacles 18 and 20 therewithin. The core or interior cavity 18 is defined by the core tube 10 and wall 16 and is definitive of a cylinder of circular cross-section. The second or outer or cladding cavity 20 is conjointly defined by the positional disposition of the outer wall surface of core tube 10 relative to the inner wall surface of shell 12 and, in the illustrated embodiment, is an annulus of uniform thickness.

The outer deformable shell 12 is suitably of the type conventionally employed in hydrostatic compaction apparatus and may be formed of rubber or deformable resinous material, such as polypropylene, polyvinyl chloride and the like. The removable thin walled core tube 10 may be constituted by any suitable material of sufficient strength and rigidity as to resist deformation and displacement during the powdered metal filling operations as hereinafter will be described, and may be conveniently formed of aluminum or steel sheet or of relatively rigid resinous material.

After selective positioning of the partition member 10 within the deformable shell 12 as described above, and as shown in FIG. 2*b*, a first metallic constituent in the form of finely divided powdered metal 22 of predetermined metallurgical character is selectively introduced into the outer or cladding cavity 20 in quantity to at least partially fill the same.

The core tube 10 is then axially displaced, as indicated by the arrow 24 in FIG. 1*c*, to elevate the dependent open end 14 thereof a predetermined distance above the closed end defining wall 16 of the deformable shell 12. Such displacement permits the lower portion of the cladding powder 22 disposed in the annulus 20 to flow downwardly and inwardly into the bottom of the shell 12, as determined by the distance *d* and the angle of repose $\alpha$ of the cladding powder, to form a generally conically contoured configuration as indicated at 26 in FIG. 1*c*.

The cladding metal cavity 22 is then substantially filled with additional powdered cladding metal 22 to a height 28 and the core cavity 18, as now defined by the displaced core tube 10 and those portions of the cladding metal powder 22 disposed longitudinally therebeneath, is simultaneously or sequentially filled to the level 28 with finely divided particles of core metal 29 of a metallurgical character different from that of said cladding metal. When so filled the outer shell 12 and its selectively constituted contents may be subjected to light jarring or tamping so as to effect a preliminary gravity induced compaction of the introduced metal particles within the cavities 18 and 20.

For the purposes of this application the terminology "discrete metals" and "different metallurgical character" and the like is intended to broadly encompass metal containing constituent materials having any ascertainable metallurgical differences therebetween and which are capable of ultimately providing an acceptable bonded interface therebetween and thus to include utilization of dissimilar metals, such as copper, steel or aluminum as well as alloys thereof such as utilization of two or more recognized alloys of aluminum. Also, as used herein, the term "aluminum base alloy" is intended to encompass all such alloys in which the major proportions, i.e., 50% or greater, is aluminum.

Following the above, and as shown in FIG. 1*d*, the partition core tube member 10 is then removed from the shell 12 by lineal displacement along its longitudinal axis as indicated by the arrow 30 in such a manner as to effect a minimal disturbance of the metal particles disposed in proximity to the inner and outer surfaces thereof. Such displacement of the core tube 10 serves to introduce the particles of the discrete core and cladding powders therefore disposed in abutting facing relation with the inner and outer surfaces of such core tube 10 into intimate interfacially engaged relation as illustrated by the dotted lines 32. Complete removal of the core tube 10 results in a composite multi-metal powder preform as illustrated in FIG. 1*e* consisting of a cylindrical core of a first metal constituent 29 disposed within a surrounding annulus of the second or cladding metallic constituent 22 with the dependent terminal end portion thereof selectively configured to provide a conically shaped end cap 34 of increasing amounts of cladding metal for the core 29. The deformable shell 12 is then conventionally sealed, as by the cap 36, and subjected to hydrostatic pressure in a suitable press to effect isostatic compaction of the composite multi-metal powdered fill be conventional techniques as for example, generally disclosed in U.S. Pat. Nos. 3,313,871 and 3,608,026. Such isostatic compaction operates to effect a marked increase in the density of the compact and in a uniform reduction of its size, as generally illustrated in FIG. 1*f* without appreciable change in the relative physical positional disposition, both internally and externally, of the now compacted and selectively disposed first and second metal constituents 22*a* and 29*a*, respectively.

For any given extrusion there will exist an optimum conical cap angle $\alpha$ that will lead to maximum product recovery of an acceptably clad product. Although the optimum will be difficult to attain, significant improvements in yield results can be obtained through a relatively wide range of cap dimensions. The dimensions of the conical cap configuration are attended with a certain degree of criticality. These dimensions are controlled by the angle of repose of the particular metal cladding powder employed, its particle size distribution, the dimension of the core tube 10 and shell 12 and by the spacing *d* between the elevated core tube 10 and the closed end wall 16 of the shell 12. As will now be apparent, the conical end cap configuration can vary from the truncated configuration illustrated to a complete cone with the apex thereof abutting the closed end partition 16 or to a truncated configuration in which the entire closed end partition 16 is covered with a base layer of cladding metal.

In the preferred practice of the subject invention, compacted composite multi-alloy billets having the requisite conical terminal end configuration are formed of aluminum base alloys for the extrusion of selectively clad aluminum base alloy products. By way of illustrative example, and in the fabrication of cylindrically shaped extrusion billets of about 7⅝ inch outside diameter and about 12 inches long, the annular cladding cavity 20 is initially partially filled with 6253 aluminum alloy powder 22. Axial elevation of the core tube 10 about 1 inch permits the cladding powder 22 to flow into the bottom of the core cavity 18 with a slope approximating that of its natural angle of repose. The core cavity 18 is then filled with 5056 alloy powder and the drop in the cladding cavity 22 is supplementally filled to the desired height with additional 6253 cladding powder. After complete removal of the core tube 10, sealing of the shell 12 and preferably evacuation thereof, the shell 12 and its contents were subjected to hydrostatic compaction. The resulting compacts were sufficiently self-supporting to permit machining and normal handling thereof.

Specimen billets were sectioned both longitudinally and transversely for etching and examination. Such examination showed a conical cap of cladding material integral with the sleeve portion thereof surrounding a core of the core alloy. These composite compacts were subsequently heated to extrusion temperature, which is well below any sintering temperature therefor, and which also concomitantly provided a degree of degassing thereof. While at extrusion temperature the compacted billets were conventionally extruded into satisfactory 2⅞ inch round corner, square alclad bars. The resulting product appeared to have interparticle bonds of nominally the same strength as those present in extrusion from composite billets fabricated in accord with conventional practice. Subsequent examination of such extruded product showed the maintained presence of a distinct line of demarcation between the two aluminum base alloy constituents thereof and without any ascertainable intermixing or infiltration of one alloy into the other as well as a markedly increased yield of acceptably clad material at the front portion of the extruded length thereof. The particles of the two alloys at the interface appeared to be joined to each other in the same manner as would be effected by particles of the same alloy.

It should also be clearly understood that while the above disclosure is specifically descriptive of a preferred cylindrical extrusion billet, the principles of the subject invention are equally applicable to the formation of billets of other desired external cross-sectional configuration such as rectangular, multi-surfaced polygonals, oval and the like and with core portions of like diverse cross-sectional configurations.

I claim:

1. A composite multi-metal compacted powder extrusion billet for the high yield extrusion of selectively clad metal products comprising a core portion of a first high density compacted metal powder of generally cylindrical configuration, an externally cylindrically shaped sleeve of a second high density compacted metal powder of metallurgical characteristics differing from that of said first compacted metal powder disposed in encircling relation with said core portion, a generally conically shaped terminal portion of decreasing cross-sectional dimension disposed at one end of said core portion; and a generally conically shaped terminal portion of complementally increasing cross-sectional dimension disposed in encircling interfacially bonded relation with said terminal portion of said core member to provide a reservoir of said second metal for the cladding of the initially extruded portions of said billet.

2. The extrusion billet as set forth in claim 1 wherein said first and second metals are aluminum base alloys.

3. The extrusion billet as set forth in claim 1 wherein the terminal end of said portion is covered by a predetermined thickness of said second metal.

* * * * *

UNITED STATES PATENT OFFICE

CERTIFICATE OF CORRECTION

Patent No. 3,941,570 Dated March 2, 1976

Inventor(s) Richard Couchman

It is certified that error appears in the above-identified patent and that said Letters Patent are hereby corrected as shown below:

Column 1, line 7, "and" should read --- end ---.

Column 4, line 44, "be" should read --- by ---.

Column 4, line 66, after "now" to read --- also ---.

Column 6, line 41, after "said" to read --- core ---.

Signed and Sealed this

Fourth Day of January 1977

[SEAL]

*Attest:*

RUTH C. MASON
*Attesting Officer*

C. MARSHALL DANN
*Commissioner of Patents and Trademarks*